US005245926A

United States Patent [19]

Hunter

[11] Patent Number: 5,245,926

[45] Date of Patent: Sep. 21, 1993

[54] GENERIC ELECTRONIC SAFE AND ARM

[75] Inventor: Donald W. Hunter, Silver Spring, Md.

[73] Assignee: United States of America as represented by the Secretary of the Army, Washington, D.C.

[21] Appl. No.: 849,547

[22] Filed: Mar. 11, 1992

[51] Int. Cl.[5] ..... F42C 15/24

[52] U.S. Cl. ..... 102/215; 102/211; 102/207; 102/248; 102/262

[58] Field of Search ..... 102/215, 217, 206, 247, 102/248, 262, 211, 207; 364/423

[56] References Cited

U.S. PATENT DOCUMENTS

| | | | |
|---|---|---|---|
| 3,153,520 | 10/1964 | Morris | 102/215 |
| 3,967,554 | 7/1976 | Troyer, Jr. | 102/215 |
| 4,157,069 | 6/1979 | Gustafsson et al. | 102/200 |
| 4,254,475 | 3/1981 | Cooney et al. | 364/900 |
| 4,369,709 | 1/1983 | Backstein et al. | 102/229 |
| 4,375,192 | 3/1983 | Yates et al. | 102/215 |
| 4,541,341 | 9/1985 | Flower et al. | 102/215 |
| 4,586,436 | 10/1986 | Denney et al. | 102/206 |
| 4,633,779 | 1/1987 | Biggs et al. | 102/215 |
| 4,646,640 | 3/1987 | Florin et al. | 102/217 |
| 4,651,646 | 3/1987 | Foresman et al. | 102/208 |
| 4,674,047 | 6/1987 | Tyler et al. | 364/423 |
| 4,700,263 | 10/1987 | Marshall et al. | 361/251 |
| 4,703,693 | 11/1987 | Spies et al. | 102/215 |
| 4,724,766 | 2/1988 | LaBudde | 102/393 |
| 4,799,427 | 1/1989 | Held et al. | 102/215 |
| 4,878,174 | 10/1989 | Watkins et al. | 364/200 |
| 5,063,846 | 11/1991 | Willis et al. | 102/215 |

FOREIGN PATENT DOCUMENTS

| | | | |
|---|---|---|---|
| 361583 | 4/1990 | European Pat. Off. | 102/215 |
| 2646504 | 11/1990 | France | 102/215 |

*Primary Examiner*—Stephen M. Johnson

*Attorney, Agent, or Firm*—Saul Elbaum; Frank J. Dynda

[57] ABSTRACT

This disclosure is directed to the use of application specific integrated circuits in safe and arm devices. The application specific circuits each comprising a buffer means for forming an environmental interface and providing input to a microcontroller, latch means for recording physical evidence, power-up reset means for providing a delayed state change which initializes the microcontroller, static and dynamic AND gate means, command arm data link register means, and a programmable counter means for providing a hard logic derived timing function.

4 Claims, 9 Drawing Sheets

GENERIC ELECTRONIC SAFE AND ARM

RIGHTS OF THE GOVERNMENT

The invention described herein may be manufactured, used and licensed by or for the United States Government for Governmental purposes without payment to us of any royalty thereon.

BACKGROUND OF THE INVENTION

1. Field of the Invention

The present invention relates to generic electronic safe and arm (ESA) devices based on a universal building-block application specific integrated circuit (ASIC) . This universal ASIC ESA is suitable for applications including missiles, rockets, artillery, mortar, mines, and submunitions.

2. Description of the Prior Art

Fuzes require some methods to prevent accidental initiation of the explosives during storage, shipping, handling, and for safe operation after launch by the delivery system. Traditionally this has been done with a mechanical or electromechanical safe and arm (S&A) which kept the sensitive explosives in the warhead out of line with the secondary explosives. After launch, the S&A would sense some unique environmental changes such as high acceleration, spin, or airflow which would release mechanical locks, allowing the sensitive explosives to move in line to set up the firing train.

An all electronic S&A has the potential to improve the safety and reliability of fuzes. This type of S&A replaces the sensitive explosives with secondary explosives in an in-line explosive train. This explosive train is initiated by an exploding foil initiator (EFI). The EFI is a small piece of metal foil on plastic (typically copper on Kapton[trademark]). The EFI is functioned by discharging electrical energy at a high voltage into the device at a very rapid rate. This discharge causes the metal foil to vaporize and form and accelerate a plastic flyer to a high velocity. This flyer impacts the lead charge of the explosive train and causes direct shock initiation.

The exploding foil initiator (EFI) , also known as the slapper detonator was developed by the DOE National Laboratories (Sandia, Los Alamos, Lawrence Livermore) in the mid 1970's for unconventional weapon applications. DOD organizations have also investigated EFI initiated, in-line explosive train technology for conventional munition applications, with an electromechanical S&A. These applications include Air Force bombs and Navy missiles.

One of the first applications for an ESA was the FOG-M Missile. The development of the ESA for this missile began in 2nd Qtr, FY86 as a U.S. Army MICOM sponsored project at Sandia National Labs with collaboration by Harry Diamond Labs. This joint effort resulted in the development of a working ESA. In addition, safety logic architectural concepts were formulated which were adopted by the Army Fuze Safety Review Board (AFSRB) as a recommended configuration. Some features of these concepts have become almost universal in US ESA applications. The most salient features of these concepts were the use of three electronic arm path interrupters (two static and one dynamic), multiple environmental signature processing, safety logic comprised of a microprocessor or microcontroller combined with additional logic devices and the concept of dynamic arming.

All known ESA developments to date employ safety logic which fits into one of the following categories.

- a microcontroller (uc) combined with standard discrete logic devices (from a manufacturers catalog and typically multisourced),
- a microcontroller (uc) combined with standard programmable logic devices (glue logic),
- a uc combined with multiple application specific integrated circuits (ASIC)-two different ASIC'S, both digital or one digital and one analog,
- all ASIC logic-typically two complex, digital complementary metal oxide semiconductors (CMOS) ASIC'S,
- all standard discrete digital "state machine" logic with counter addressed large read only memories (ROM)s and additional logic, or
- all standard discrete digital logic.

In these applications, non-standard devices such as ASIC's are developed and configured like ordinary commercial devices They are without specific safety enhancing features. The problems and disadvantages to implementing ESA safety logic with these approaches are numerous and include:

The configuration of many of these designs masks or makes it difficult to identify elements critical to the arming process (safety critical);

Many of these designs are needlessly complex with greater than necessary development cost, risk, and component cost;

None of these designs makes good use of safety enhancing techniques such as multiple power and ground pins and specific architectural features; and the designs which do not include a microcontroller (uc) have limited computing power for processing sensor and data bus signals or performing arithmetic operations.

Accordingly, it is an object of this invention to provide a universal building block Application Specific Integrated Circuit (ASIC) which is used multiple times in an Electronic Safe and Arm (ESA) rather than using several ASIC designs in an ESA system thereby enabling one to configure an ESA for many applications.

It is another object of this invention to provide unique safety enhancing features in the ESA consisting of:

- multiple power and ground pins on the ASIC,
- redundant power up reset functions (within the ESA),
- an architecture which clearly identifies safety critical elements,
- a command arm/data link register that can be interrogated by the microcontroller during a mission and which will receive data at a high rate or will provide a unique code word to complete a software oscillator or to compare to a data bus "good guidance" or "command arm" word,
- safety critical status of the microcircuit that can be chosen for a particular application,
- bi-phase ASIC input functions wherein one input is inactive in the low state and the other input is inactive in the high state and both inputs must change to the opposite state to become active, and
- "shielding" for the pins of safety critical functions; e.g., an arm switch output which is inactive in the low state and is positioned between two ground pins.

SUMMARY

Briefly, the foregoing and other objects are achieved by a generic Electronic Safe and Arm (ESA) which combines a "building block" Application Specific Integrated Circuit (ASIC), used multiple times with a microcircuit to form ESA safety logic with unique features. The functions included in this ASIC are: buffers, latchs, power reset, static AND gate, dynamic AND gate/latch, command arm register, programmable counter, and rocket motor control logic. Other features included in this ASIC are: multiple V+ and ground pins, an architecture which clearly identifies safety critical elements, control of the safety critical status of the microcircuit, and shielding for the pins of safety critical functions. This ASIC and ESA concept bring together a unique combination of safety enhancing and functional characteristics.

BRIEF DESCRIPTION OF THE DRAWING

A better understanding of the invention will be obtained when the following detailed description of the invention is considered in connection with the accompanying drawings in which:

FIGS. 4, A & B, is a schematic of the ASIC chip package.

DETAILED DESCRIPTION OF A SPECIFIC EMBODIMENT

The following description is of a specific embodiment of this invention, in this case the ESA for a specific application, the AAWS-M missile. Other possible embodiments include an ESA for the FOG-M, TOW22B, Patriot, ATACMS, Hellfire and others.

Figure 1:
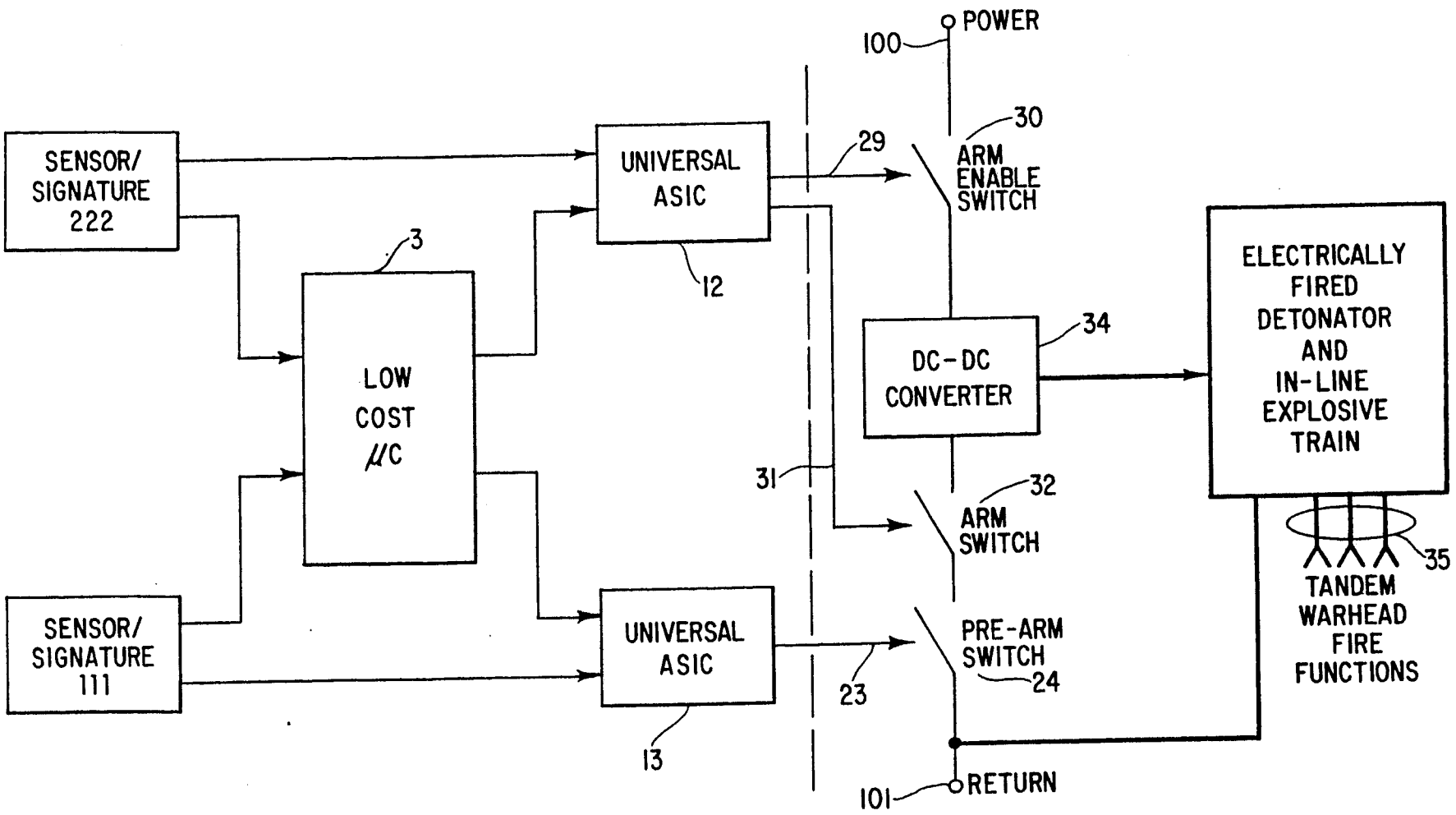
FIG. 1 is a basic block diagram of the ESA using the universal ASIC building block concept.

FIG. 1 is a block diagram of a basic ESA using the Universal ASIC building block concept. It is seen that the three arm path interrupters 24, 32, and 30 are controlled by the universal ASIC'S 12, and 13 with no direct interface to the uc, and that two environmental sensors 111 & 222 (signatures) are processed in both the uc 3 and other circuits with functions combined in the ASIC'S.

Figure 2:
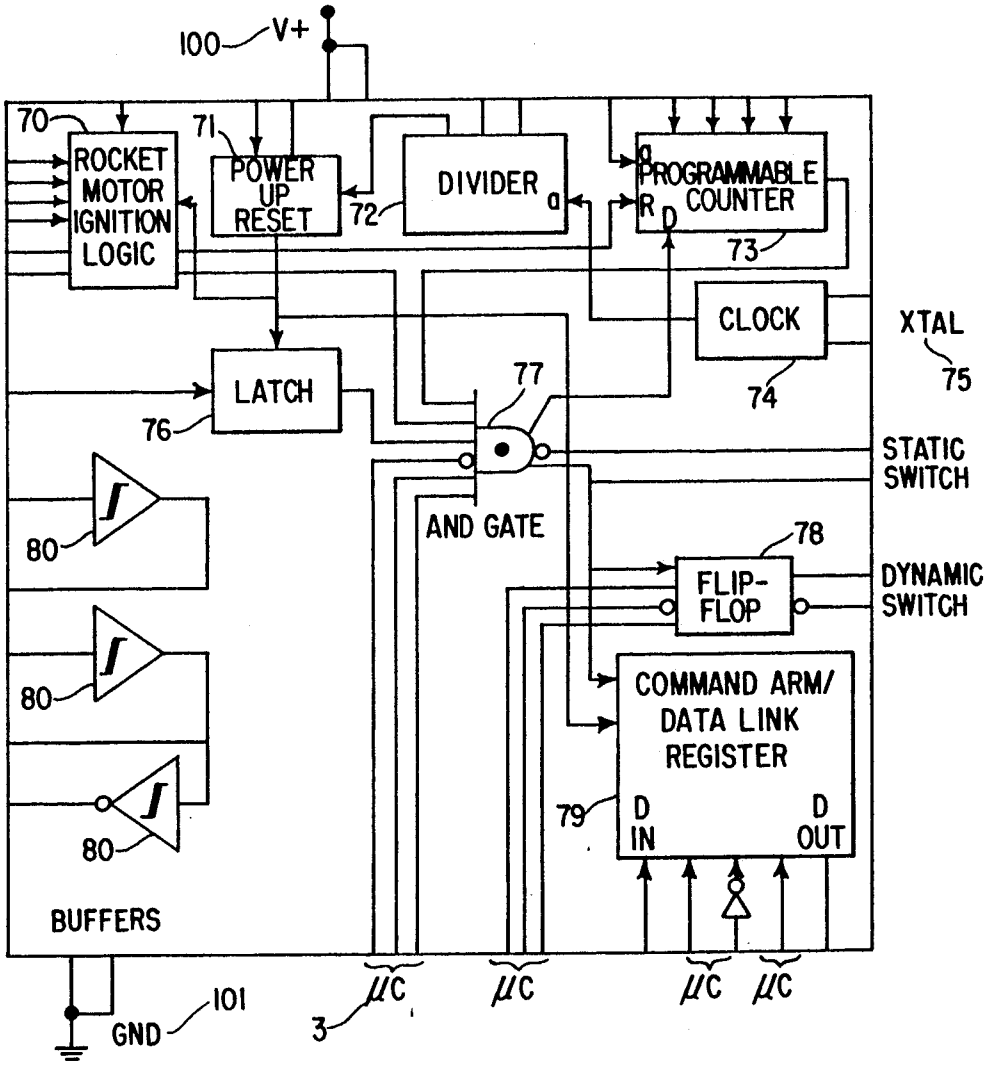
FIG. 2 is a block diagram of a universal ASIC for ESA applications.

FIG. 2 is a block diagram of a Universal ASIC. It contains the following functions: buffers 80, latches 76, power-up reset 71, rocket motor ignition logic 70, time base (clock) 74, divider 72, programmable counter 73, "Smart AND gate" 77, flip-flop 78, and command arm-/data link register 79.

Figure 3:
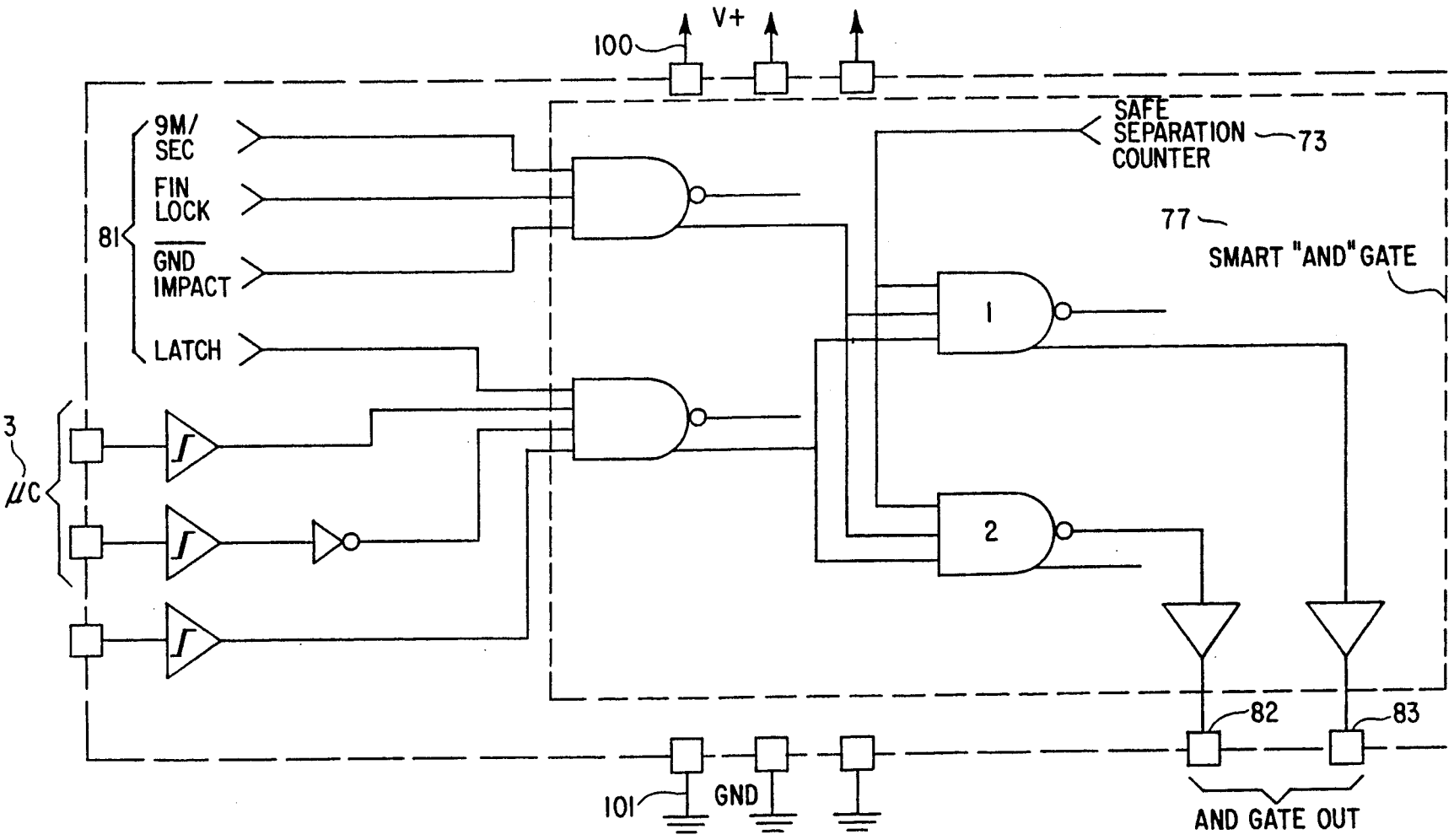
FIG. 3 is a diagram of the ASIC Smart "AND" gate function.
Figures 1, 4A:
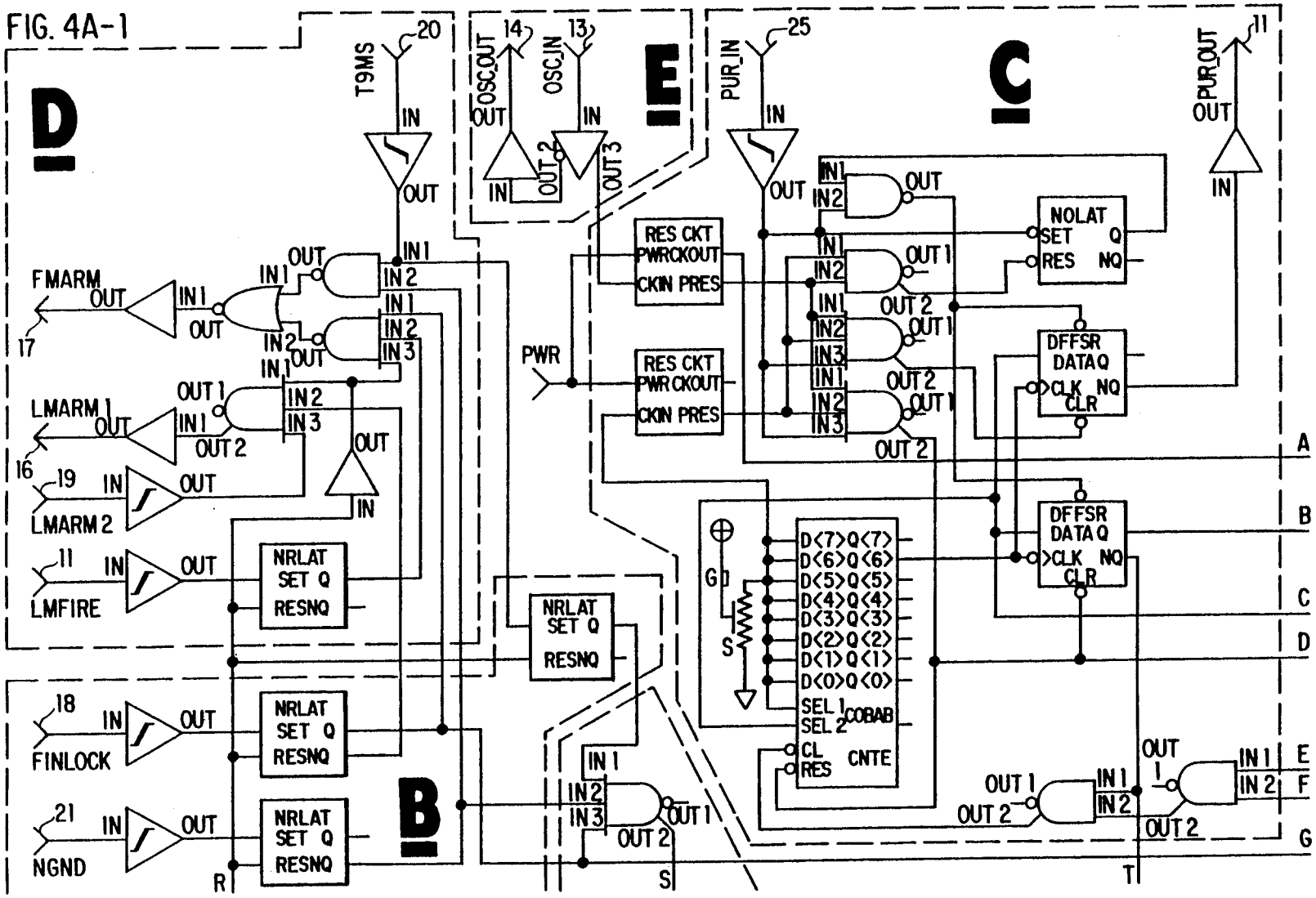
Figures 2, 4A:
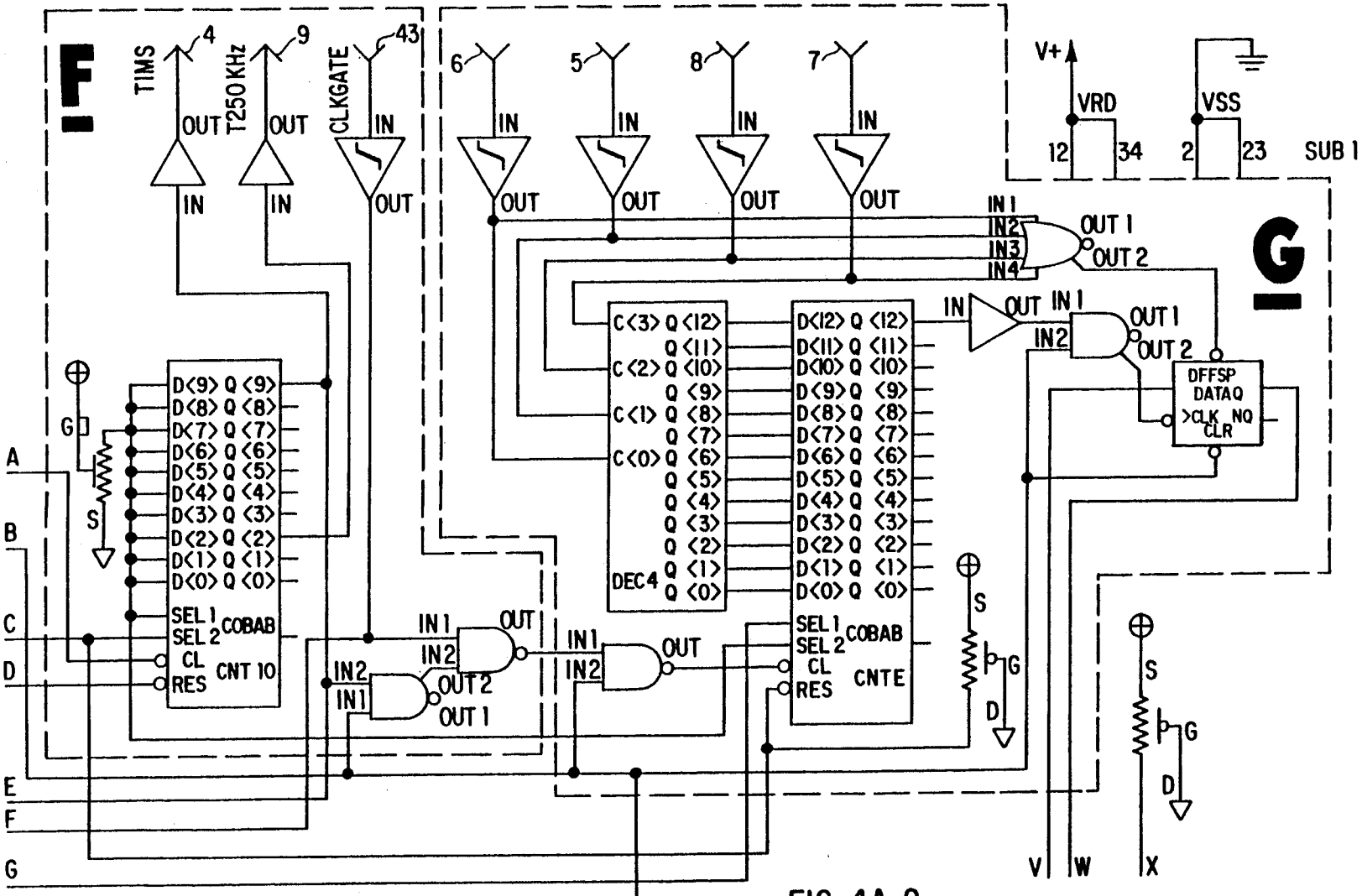
Figures 1, 4B:
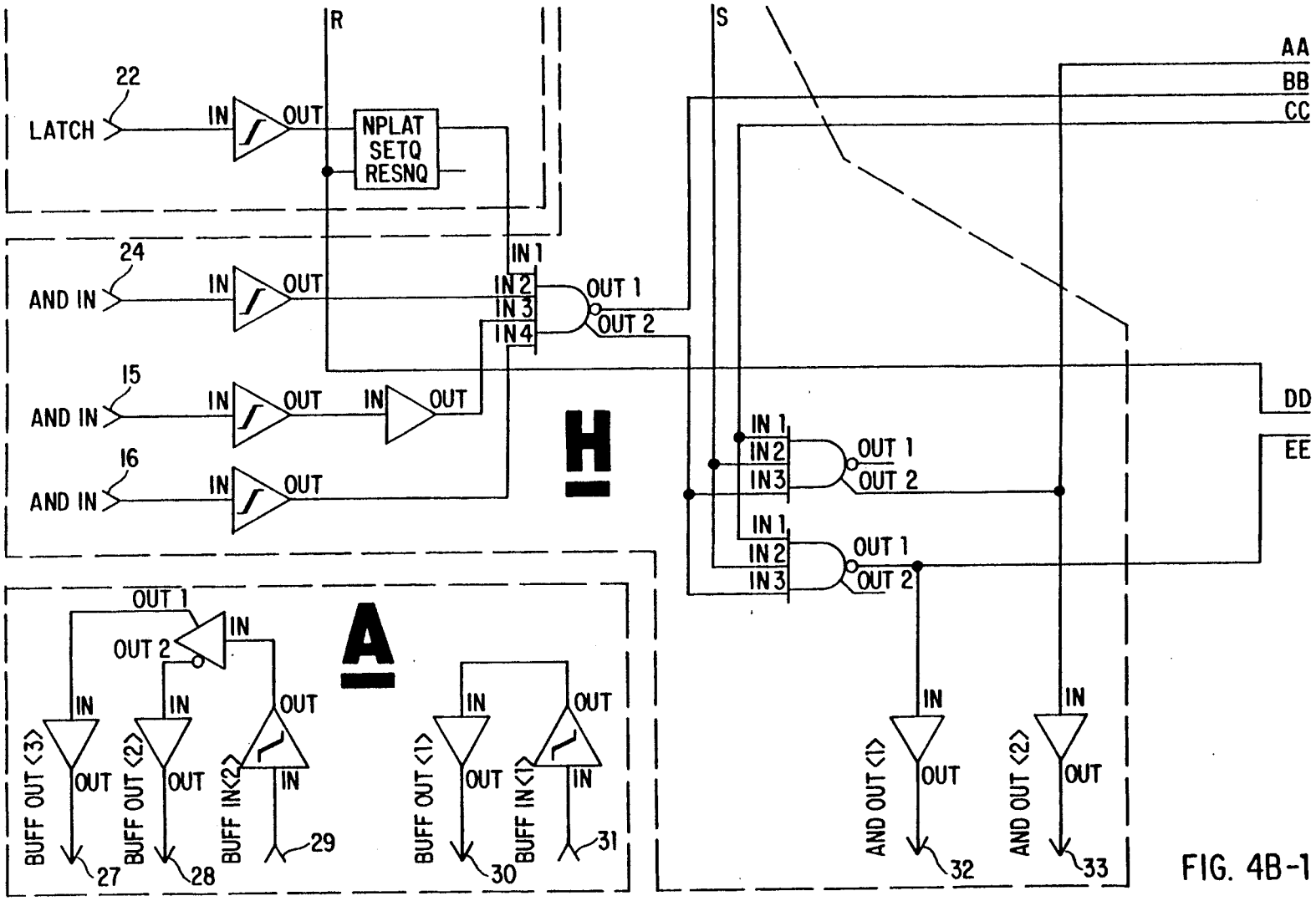
Figures 2, 4B:
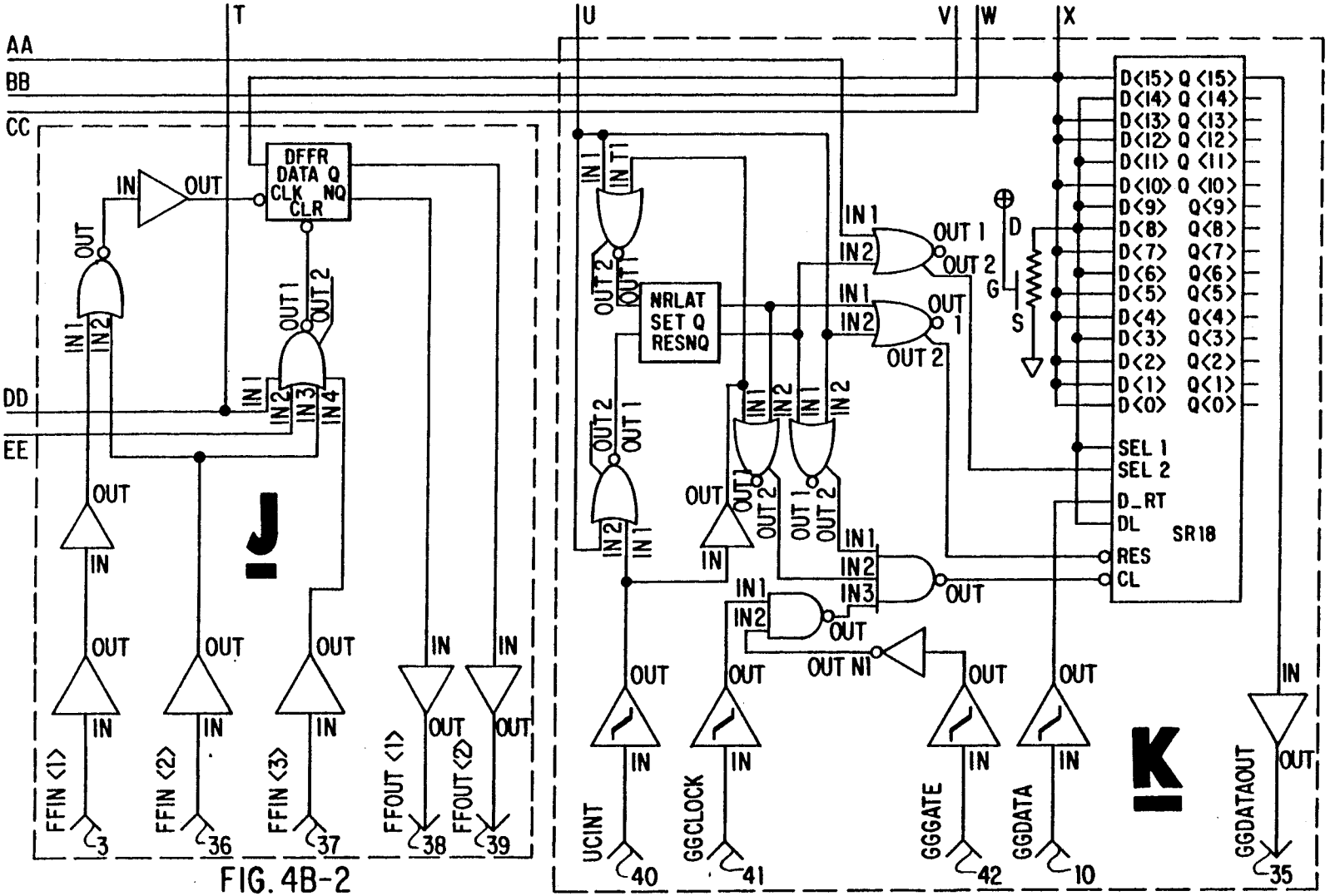

FIG. 3 shows the "Smart AND gate" 77 function incorporated within a Universal ASIC. It does the following:

Combines uc 3 and other functions 81 with the programmable counter 73 (safe separation time) output. These other functions 81 can be as labeled, from an ASIC(s), or from sensor processing circuits. The parts of the "AND" gate which interface with the arm path interrupters are labeled 1 & 2. These are independent "and" gates with inputs in parallel and separate outputs 83 and 82. In an ESA, "and" gate 1 would be used in one ASIC to control one arm path interrupter (typically static) and "and" gate 2 in the other ASIC (FIGS. 2 & 5) to control another arm path interrupter (typically static). Positioning the "AND" gate 77 in this manner reduces susceptibility to process induced or other common mode failures. The multiple V+ 100 and ground 101 connections shown also have this characteristic.

Referring to FIG. 4, the pin connections for various functions are shown as used o an actual ASIC chip. This FIG. 4 is shown to clarify the actual reduction to practice of an embodiment to one skilled in the art. It is not needed to describe the invention and therefore is not number correlated to the specification. Typical functions from FIG. 2 are identified in FIG. 4 as follows: A-buffers 80, B-latches 76, C-power-up reset 71, D-rocket motor ignition logic 70, E- time base 74, F-divider 72, G-programmable counter 73, H-Smart AND gate 77, J-flip-flop 78, K-command arm/data link register 79.

Figure 5A:
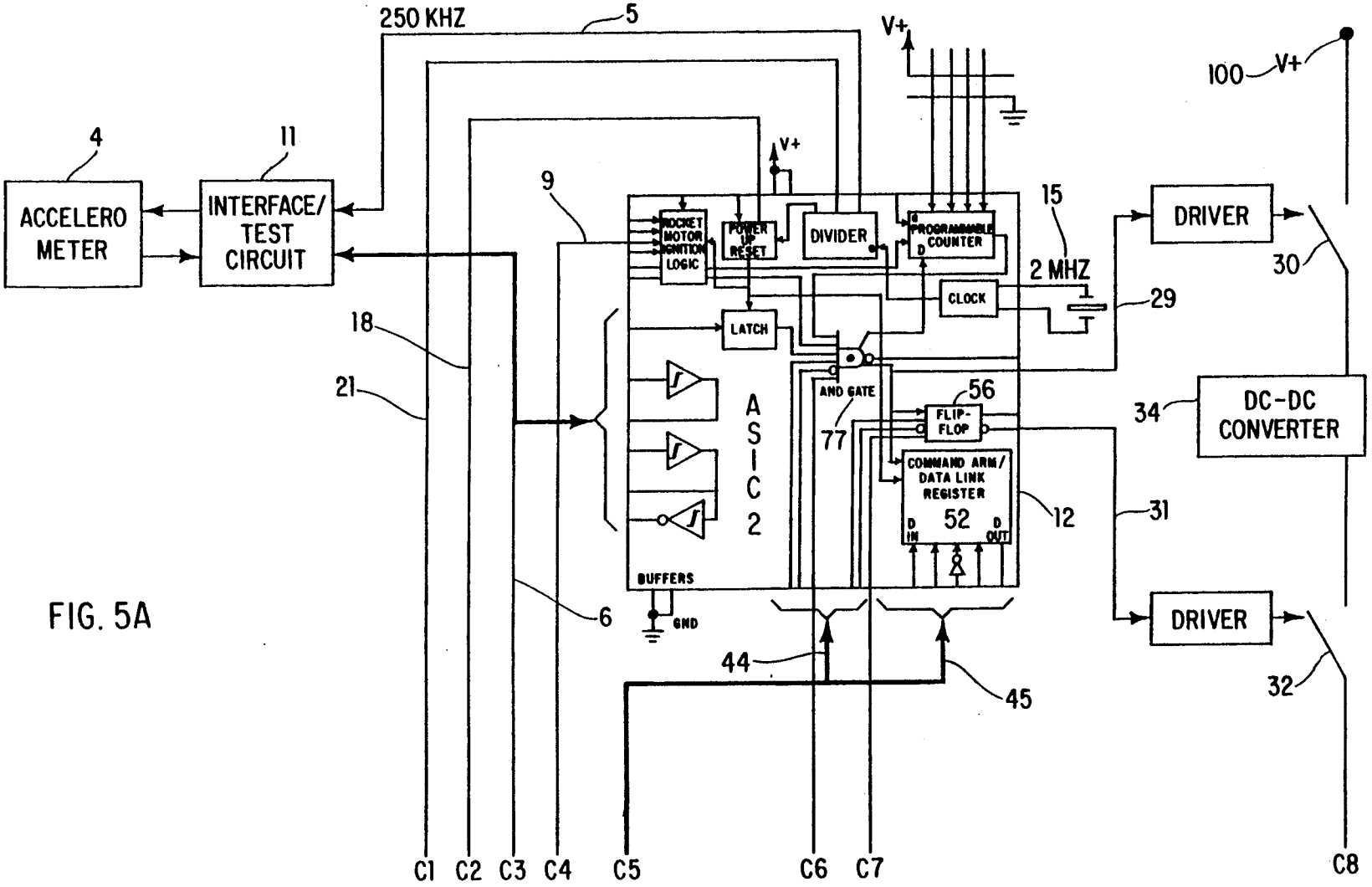
FIGS. 5, A & B, shows the configuration of the universal ASIC ESA for the AAWS-M system.
Figure 5B:
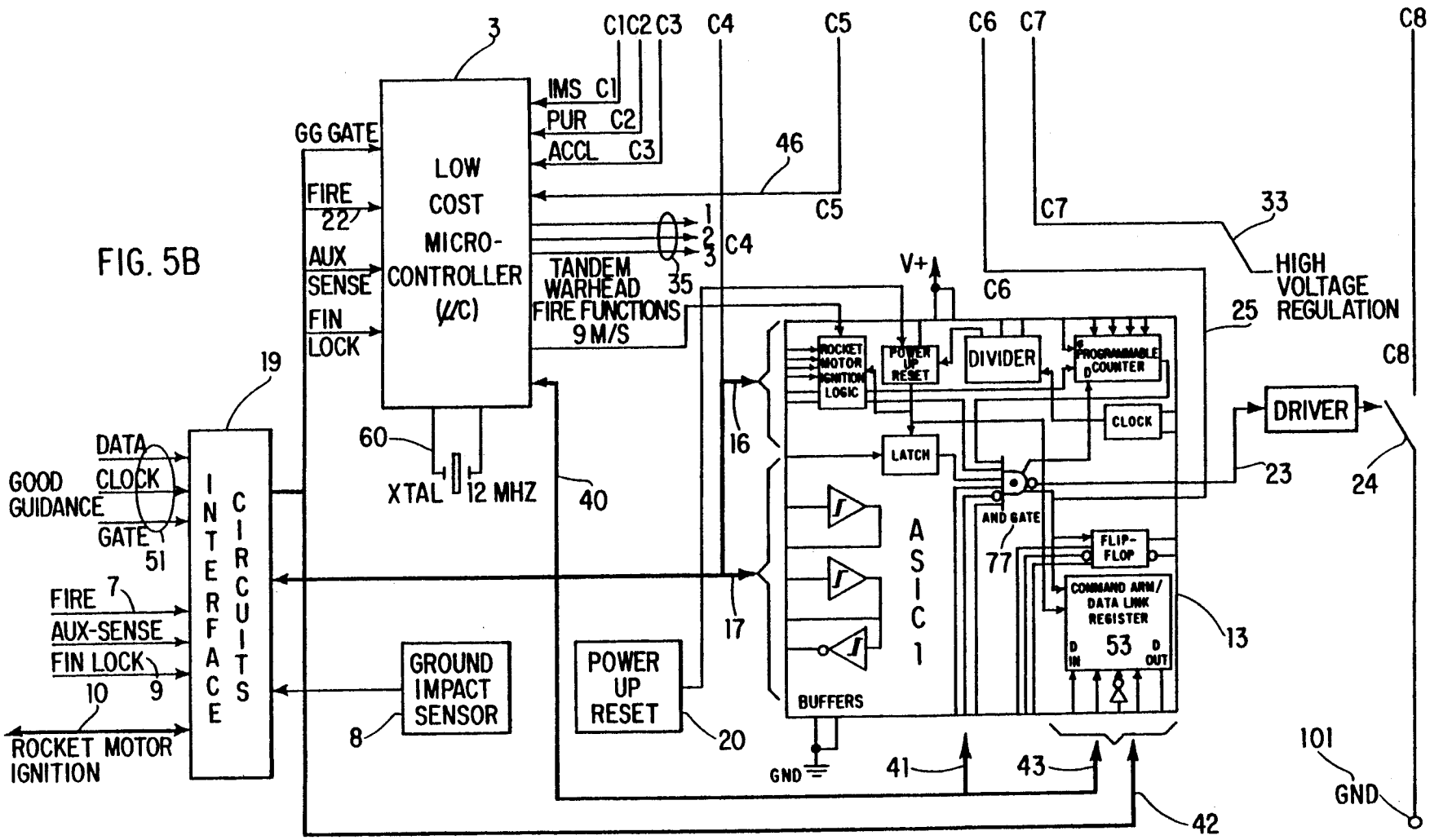

An embodiment of this Universal ASIC ESA is shown in FIG. 5, in this case for the AAWS-M missile. The significant events during a mission of the AAWS-M missile are listed, with the approximate times relative to launch in parenthesis:

A. Activate missile battery ($t_o$—0.5 sec)
B. Launch ($t_o$)
C. First Motion—fin lock ($t_o$+0.12 sec)
D. Coast—ignite flight motor ($t_o$+0.5 sec)
E. Good Guidance Words—fire delays, good guidance no go, and good guidance go ($t_o$+0.3→0.9 sec)
F. Safe Separation Distance (25-60 M), Arm ($t_o$+1.1→1.75 sec )
G. Fire, precursor 1, delay 1 to precursor 2, delay 2 to Main warhead ($t_o$).

The function of the ESA is to prevent arming during events A-F ($10^{-6}$ probability of inadvertent arming requirement of MIL-1316), reliably arm the system after event F and then control the initiation timing to precursors and main warheads not part of the invention) at event G.

Referring to FIG. 5, the first event of a mission is to initiate the missile battery and power the ESA at V+ 100 and Gnd 101. This event causes the XTAL oscillator 15 to start and causes the power-up reset (PUR) circuit 18 to initialize the logic ASIC 2 12, the uc 3 and clock signals 5 and 21. The XTAL 60 in uc 3 provides its time base of 12 Mhz. Similarly, the PUR 20 of ASIC 1 13 initializes its logic circuits. After the PUR events, uc 3 performs a initialization check. The algorithms and software for the uc 3 include many options for performing the ESA functions. This initialization check would typically include: comparing clock signal 21 to the uc 3 clock for proper operation, testing interface circuit 11 and 19 outputs for the correct initial state, testing several other signals for the correct initial state such as fire 7, fin lock 9, and testing the accelerometer 4 output for a frequency corresponding to an acceleration of 0 g's. This testing is done by comparing the states and transition timing of the functions or signals under test to criteria contained in the test algorithms.

After the initialization check, the next event is launch. At this time, the fins deploy and close the fin-lock switch and provide a first motion signal to ASICs 1 and 2, 13 and 12 respectively. This signal is conditioned in the interface circuit 19 which uses buffers in ASIC 1 13 as active elements. The fin-lock switch closure occurs 0.12 sec. after $t_o$. The first motion signal in uc 3 is derived by monitoring the pulse train from accelerometer 4. This pulse train is conditioned in interface circuit 11, and buffers in ASIC 2 12, and inputs uc 3 on line 6. The average frequency of this pulse train is proportional to acceleration. When the frequency of this pulse train corresponds to an acceleration of 2 g's for several milliseconds, first motion has occurred. Algorithms in uc 3 then double integrate the accelerometer signal to derive velocity an distance and also begin a timing function. This fin-lock first motion signal also begins the "countdown" in the programmable counter in ASIC 2 12. The time set in this counter is slightly less than the anticipated time to reach the safe separation distance. The two events of fin-lock and uc 3 timing function together comprise the first environmental signature for arming (a MIL-1316 requirement). Output lines from uc 3, 40/41 change state (one from L to H and one from H to L [biphase]) and provide enabling inputs to the smart AND gate 77 in ASIC 1 13. Output line 23 from the smart AND gate goes low and turns on the Pre-Arm switch 24. The other output from this gate 25 provides an enabling input to the smart AND gate 77 in ASIC 2 12. An algorithm in uc 3 also derives a 9 ms time window signal which along with the uc 3 timing function enables the flight motor logic. The flight motor is fired when the motor ignition signal 10 occurs from the missile. After launch ($t_o$+0.3 sec.) and during the time the safe separation distance is being processed in uc 3, the good guidance words are sent to the ESA by the missile on data, clock, and gate lines 51 and 42. The data link register 52 is later interrogated by uc 3 on lines 43. These signals are conditioned in interface circuit 19 and transfer data to the command arm/data register 52 in ASIC 1 13. The data rate for the AAWS-M is too high to directly transfer into uc 3. The command arm/data link register 52 receives this data and then is interrogated by uc 3 at a low data rate to transfer the data into uc 3. An interrupt in the accelerometer algorithm allows these words to be entered into uc 3 On lines 40. These words are stored in uc 3 and program the warhead fire delays and provide a "no-go" word until approximately $t_o$+0.9 sec. At this time, the good guidance "go" word is provided and is stored until required at the start of arming.

When the safe separation distance is decoded in uc 3, output lines 44 change state (one from L to H and one from H to L) and along with the programmable counter output provide enabling inputs to the smart AND gate in ASIC 2 12. Safe separation distance combined with the output of the programmable counter (which corresponds to slightly less than time to safe separation distance) comprise the second environmental signature for arming (MIL—1316 requirement). Output line 29, from a different part of the Smart AND Gate used in ASIC 2 12 goes high and turns on the Arm-Enable switch 30. This event also enables the flip-flop 56 and command arm/data link register 52 in ASIC 2 12. After the Arm - Enable event, uc 3 also sends a clock signal 45 for interrogation similar in format to 43, to the Command Arm register 52 in ASIC 2 12. The Command Arm code word contained in this register is transferred into uc 3 on lines 46. This code word is 16 bits in length and contains error detecting information. An algorithm in uc 3 tests this command arm word by comparing the information bits to the error detecting bits. If the command arm word is accepted the Good Guidance "no-go", and "go", words and the Command Arm word then enable a software oscillator in uc 3 which generates a dynamic clock signal on lines 44 similar in format to 43. The frequency of this signal is related to the specific bit patterns of these words. The Good Guidance "go" word repeats every 16.6 ms and the software oscillator stops if it is not received or has an incorrect bit pattern. The leading edge of this signal 44 "sets" the flip-flop 56 and causes line 31 to go low and turn on the dynamic arm switch 32. The flip-flop can be reset by the trailing edge of this signal or by a signal on line 33 that would come from a voltage regulator circuit not shown. Possible operating modes include cycle-by-cycle pulse width modulation control and hysteresis control. Dynamic action of switch 32 operates the dc-dc converter 34 and causes the fire set energy storage capacitors to charge and arm the system. Details of the dc-dc converter are not shown and are not part this invention.

At the end of a mission, the target is detected by the missile and a fire signal is generated and appears on line 7. This signal is conditioned by the interface circuit 19 and provides an input 22 to uc 3. The algorithm in uc 3, with the stored Good Guidance fire delay information generates the fire signals on lines 35. These signals go to the fire set modules not shown and not part of this invention, and trigger the modules which initiate precursors and main warheads (not part of this invention).

In FIG. 5, other missile systems are also identified which are compatible with this preferred embodiment. Only minor changes are required to accommodate these other systems. Specifically, these changes are in the environmental signatures and sensors used, the required interface circuits, the details of the missile/missile data bus interface, the uc software, and the interconnection between the ASICs and uc. These other identified missile systems include applications with a data bus interface between the missile and the ESA. In the present embodiment the ground impact sensor 8 is not part of the invention, but is shown for clarity. Also 16 and 17 control rocket motor functions in the embodiment shown. Function 33 is a comparator output which regulates the voltage on the high voltage capacitors in the fire set (also not part of this invention, but mentioned for clarity). Also included are applications where the ESA replaces an electromechanical ESA. In this use there is no data bus, only pulses which previously activated solenoids. For both types of similar to FIG. 5.

Some salient features of the preferred embodiment of FIG. 5, which enhance safety include:

The basic ASIC (1&2, 13&12) is used as a building block in the system.

Separation of safety critical functions—ASIC 1 13 directly controls only the Pre-Arm switch 24, and ASIC 2 12 directly controls the Arm Enable switch 30. The arm switch drive signal 44 is enabled by ASIC 2 12. Other safety critical functions such as PUR, clocks, safe separation time, interface circuit buffers, command arm-/data link register, and arm switch drive are divided between the two ASIC'S.

One part of the smart AND gate is used in ASIC 1 13 and another part of the gate is used in ASIC 2 12. FIG. 3 shows a detailed description of the smart AND gate concept. This use of the smart AND gate makes the system (ESA) resistant to the effects of processing defects, handling abuse, or other factors which may make a particular part of the ASIC prone to a specific type of failure.

The safety critical status of uc 3 is defined and controlled by its relationship to ASIC 1&2, 13&12. Other applications than the preferred embodiment of FIG. 5 may use the uc differently.

Safety of the preferred embodiment of FIG. 5 is enhanced by the features of the ASIC previously described.

Having described this invention, it should be apparent to one skilled in the art that the particular elements of this invention may be changed, without departing from its inventive concept. This invention should not be restricted to its disclosed embodiment but rather should be viewed by the intent and scope of the following claims.

What is claimed is:

1. A generic electronic safe and arm ESA device, for use in a fuze utilizing an in-line explosive train and an electrically fired detonator, comprising:

a plurality of universal application specific integrated circuits used as building blocks, a microcontroller connected to environmental sensor outputs, and wherein said microcontroller is connected to arm path interrupters via said application specific integrated circuits, and wherein each of said application specific integrated circuits comprises:

latch means output for recording physical events sensed and outputted by said environmental sensor outputs, power-up reset means for providing a delayed state change which initializes sequential elements in said application specific integrated circuits and said microcontroller, AND gate means for combining said latch means output for directly controlling an arm switch, command arm data link register means which receives data and is interrogated during an arming sequence by said microcontroller for providing a command arm code word to said microcontroller, and a programmable counter means for providing a timing function to said microcontroller.

2. An application specific integrated circuit as in claim 1 wherein said AND gate means isolates said microcontroller from directly controlling said arm switch.

3. An application specific integrated circuit as in claim 1 comprising support logic architecture means for providing multiple processing of said environmental sensor outputs thereby providing multiple independent verification of elements critical to an arming process thereby increasing safety.

4. An application specific integrated circuit as in claim 1 comprising bi-phase input functions wherein one input is inactive in a low state and another input is inactive in a high state and each of said inputs change to an opposite state to become active.

* * * * *